US010286678B2

(12) United States Patent
Matsunaga

(10) Patent No.: US 10,286,678 B2
(45) Date of Patent: May 14, 2019

(54) INKJET PRINTER WITH AIR BUBBLE DISCHARGE FUNCTION

(71) Applicant: RISO KAGAKU CORPORATION, Tokyo (JP)

(72) Inventor: Katsuhiko Matsunaga, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 19 days.

(21) Appl. No.: 15/812,143

(22) Filed: Nov. 14, 2017

(65) Prior Publication Data

US 2018/0147855 A1 May 31, 2018

(30) Foreign Application Priority Data

Nov. 25, 2016 (JP) ..... 2016-228954

(51) Int. Cl.
*B41J 2/19* (2006.01)
*B41J 2/175* (2006.01)

(52) U.S. Cl.
CPC ..... *B41J 2/19* (2013.01); *B41J 2/175* (2013.01); *B41J 2/17596* (2013.01)

(58) Field of Classification Search
CPC .... B41J 2/17513; B41J 2/17596; B41J 2/175; B41J 2/17509; B41J 2/18; B41J 29/38; B41J 2/17566; B41J 2/17523; B41J 2/19; B41J 2/17556
USPC ..... 347/6, 7, 9, 14, 65, 84–86, 89, 92
See application file for complete search history.

(56) References Cited

U.S. PATENT DOCUMENTS

2007/0222843 A1 9/2007 Uchiyama et al.
2011/0128334 A1* 6/2011 Akiyama ..... B41J 2/17509 347/86
2015/0224786 A1* 8/2015 Otsuka ..... B41J 2/175 347/92

FOREIGN PATENT DOCUMENTS

JP 2007-230042 9/2007

* cited by examiner

*Primary Examiner* — Bradley W Thies
(74) *Attorney, Agent, or Firm* — Greenblum & Bernstein, P.L.C.

(57) ABSTRACT

An inkjet printer includes: a closing unit configured to close at least part of an ink passage connected to an inkjet head to form a closed passage; a negative pressure generator configured to generate a negative pressure in the closed passage; an ink deliverer configured to deliver ink to the inkjet head via the ink passage; and a controller. The controller: drives the closing unit to form the closed passage; drives the negative pressure generator to generate the negative pressure in the closed passage; and, upon the negative pressure in the closed passage reaching a prescribed pressure, stops the negative pressure generator while driving the closing unit to release closure of the at least part of the ink passage, and drives the ink deliverer to discharge an air bubble together with the ink in the at least part of ink passage from the inkjet head.

8 Claims, 5 Drawing Sheets

INKJET PRINTER WITH AIR BUBBLE DISCHARGE FUNCTION

CROSS REFERENCE TO RELATED APPLICATION

This application is based upon and claims the benefit of priority from the prior Japanese Patent Application No. 2016-228954, filed on Nov. 25, 2016, the entire contents of which are incorporated herein by reference.

BACKGROUND

1. Technical Field

The disclosure relates to an inkjet printer which performs printing by ejecting ink from an inkjet head.

2. Related Art

In an inkjet printer, there is a case where air bubbles enter an ink passage in initial filling of an inkjet head with ink or replacement of an ink cartridge.

Japanese Patent Application Publication No. 2007-230042 discloses that air bubbles in an ink passage are removed by, for example, cleaning in which the inkjet head sucks and discharges the air bubbles and foreign objects together with ink.

SUMMARY

In some cases, the air bubbles remain in the ink passage even after cleaning like that described above is performed. For example, when a filter for removing foreign objects is provided in the ink passage, the air bubbles are divided into fine air bubbles by the filter and the fine air bubbles sometimes remain in a horizontal section or the like of the ink passage.

When the air bubbles remain in the ink passage, for example, the air bubbles may be sent to the inkjet head at unexpected timing and cause ink ejection failure.

The disclosure is directed to an inkjet printer which can reduce air bubbles in an ink passage.

An inkjet printer in accordance with some embodiments includes: an inkjet head; an ink passage connected to the inkjet head; a closing unit configured to close at least part of the ink passage to form a closed passage; a negative pressure generator configured to generate a negative pressure in the closed passage formed by the closing unit; an ink deliverer configured to deliver ink to the inkjet head via the ink passage; and a controller configured to control the closing unit, the negative pressure generator, and the ink deliverer. The controller is configured to execute an air bubble discharge processing. The air bubble discharge processing includes: driving the closing unit to form the closed passage; driving the negative pressure generator to generate the negative pressure in the closed passage; and, upon the negative pressure in the closed passage reaching a prescribed pressure, stopping the negative pressure generator while driving the closing unit to release closure of the at least part of the ink passage, and driving the ink deliverer to discharge an air bubble together with the ink in the at least part of ink passage from the inkjet head.

In the configuration described above, the air bubbles attaching to an inner wall of the ink passage can be discharged by being made to float up and joined together to form the larger air bubbles. As a result, it is possible to facilitate the discharge of the air bubbles and reduce the air bubbles in the ink passage.

In the air bubble discharge processing, upon the negative pressure in the closed passage reaching a waiting pressure smaller than the prescribed pressure, the controller may control the negative pressure generator to maintain the negative pressure in the closed passage at the waiting pressure for a prescribed time and then increase the negative pressure in the closed passage to the prescribed pressure.

The configuration described above can join more air bubbles by providing a time waiting for the air bubbles attaching to the inner wall of the ink passage to float up. As a result, it is possible to facilitate the discharge of the air bubbles and reduce the air bubbles in the ink passage.

The at least part of the ink passage may have a protruding portion protruding upward in a vertical direction.

In the configuration described above, since the ink passage has the protruding portion, the air bubbles tend to gather in the protruding portion. Accordingly, joining of the air bubbles can be further promoted in the air bubble discharge processing. This can facilitate discharging of the air bubbles and further reduce the air bubbles in the ink passage.

The inkjet printer may further include an air bubble detector configured to detect an air bubble at the protruding portion in the ink passage. The controller may execute the air bubble discharge processing upon detection of the air bubble accumulated at the protruding portion by the air bubble detector.

In the configuration described above, the air bubble discharge processing can be efficiently performed depending on presence or absence of the air bubbles accumulating in the ink passage.

The closing unit may include valves, and the negative pressure generator and the ink deliverer may include a pump.

DETAILED DESCRIPTION

Figure 1:
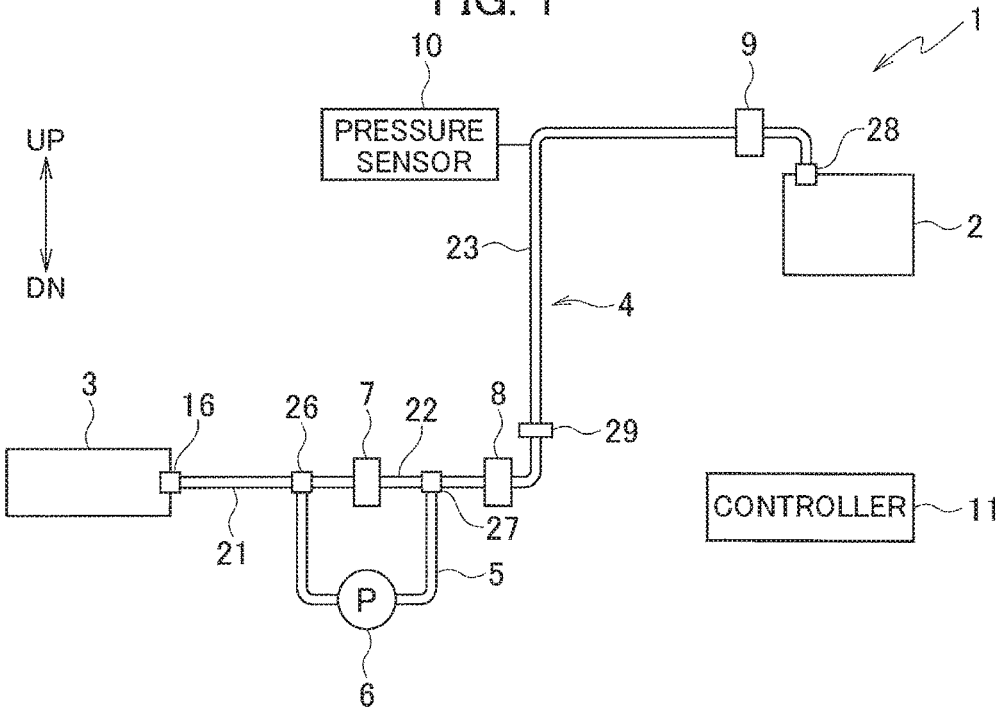
FIG. 1 is a schematic configuration diagram of an inkjet printer according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

In FIGS. 1, 4, 5, and 8, directions of up and down are denoted by UP and DN, respectively.

First Embodiment

FIG. 1 is a schematic configuration diagram of an inkjet printer 1 according to a first embodiment of the present invention. As illustrated in FIG. 1, the inkjet printer 1 includes an inkjet head 2, an ink cartridge 3, an ink passage 4, a branching passage 5, a liquid delivery pump (ink delivery pump) 6, a first valve 7, a second valve 8, a third valve 9, a pressure sensor 10, and a controller 11.

The inkjet head 2 has multiple ink chambers (not illustrated) for storing ink and multiple nozzles (not illustrated) communicating with the respective ink chambers, and prints an image by ejecting the ink from the nozzles to a print medium.

The ink cartridge 3, which can be regarded as a tank, holds the ink to be supplied to the inkjet head 2. The ink cartridge 3 is disposed below the inkjet head 2. The ink cartridge 3 is connected to an upstream end of a cartridge side passage 21 in the ink passage 4 to be described later, via a cartridge joint 16. In the ink passage 4, the ink cartridge 3 side is referred to as an upstream side and the inkjet head 2 side is referred to as a downstream side.

The ink passage 4 connects the ink cartridge 3 and the inkjet head 2 to each other. The ink passage 4 has the cartridge side passage 21, a direct passage 22, and a head side passage 23. The cartridge side passage 21, the direct passage 22, and the head side passage 23 are formed of tubes.

The cartridge side passage 21 is a passage between the ink cartridge 3 and a point where the branching passage 5 branches from the ink passage 4. The cartridge side passage 21 is installed horizontally. The upstream end of the cartridge side passage 21 is connected to the ink cartridge 3 via the cartridge joint 16 and a downstream end of the cartridge side passage 21 is connected to an upstream end of the direct passage 22 and an upstream end of the branching passage 5 via a branching joint 26. The branching joint 26 is disposed at the point where the branching passage 5 branches from the ink passage 4.

The direct passage 22 is a passage in the ink passage 4 which is between the point where the branching passage 5 branches from the ink passage 4 and a point where the branching passage 5 merges with the ink passage 4 downstream of the branching point. The direct passage 22 is installed horizontally. The upstream end of the direct passage 22 is connected to the downstream end of the cartridge side passage 21 and the upstream end of the branching passage 5 via the branching joint 26. A downstream end of the direct passage 22 is connected to an upstream end of the head side passage 23 and a downstream end of the branching passage 5 via a merging joint 27. The merging joint 27 is disposed at the point where the branching passage 5 merges with the ink passage 4.

The head side passage 23 is a passage between the inkjet head 2 and the point where the branching passage 5 merges with the ink passage 4. The head side passage 23 is installed such that an upstream portion and a downstream portion thereof are horizontal passages and a mid-stream portion is a passage which extends upward from the upstream portion to the downstream portion. The upstream end of the head side passage 23 is connected to the downstream end of the direct passage 22 and the downstream end of the branching passage 5 via the merging joint 27. A downstream end of the head side passage 23 is connected to the inkjet head 2 via a head joint 28. A filter 29 which removes foreign objects from the ink is disposed in the head side passage 23.

The branching passage 5 is a passage for installing the liquid delivery pump 6. The branching passage 5 is formed of a tube. One end (upstream end) of the branching passage 5 is connected to the downstream end of the cartridge side passage 21 and the upstream end of the direct passage 22 in the ink passage 4 via the branching joint 26. The other end (downstream end) of the branching passage 5 is connected to the downstream end of the direct passage 22 and the upstream end of the head side passage 23 in the ink passage 4 via the merging joint 27.

The liquid delivery pump 6 delivers the ink from the ink cartridge 3 to the inkjet head 2. The liquid delivery pump 6 is disposed in the branching passage 5. The liquid delivery pump 6 is formed of a tube pump. The liquid delivery pump 6 can be driven in forward and reverse directions and delivers the ink from the ink cartridge 3 to the inkjet head 2 when driven in the forward direction. Moreover, the liquid delivery pump 6 generates a negative pressure in a closed passage formed by the first valve 7 and the third valve 9 when driven in the reverse direction in air bubble discharge processing to be described later. The liquid delivery pump 6 functions as an ink deliverer when driven in the forward direction and functions as a negative pressure generator when driven in the reverse direction.

The liquid delivery pump 6 is disposed in the branching passage 5 because, in order to generate an appropriate negative pressure at the nozzles of inkjet head 2 with a hydraulic head difference between the inkjet head 2 and the ink cartridge 3, the liquid delivery pump 6 should not be located in the ink passage 4.

The first valve 7 is disposed in the direct passage 22 and opens and closes a flow passage for fluids (ink, air) in the direct passage 22. The second valve 8 and the third valve 9 open and close a flow passage for the fluids in the head side passage 23. The second valve 8 is disposed in a horizontal section in the upstream portion of the head side passage 23. The third valve 9 is disposed near and upstream of the inkjet head 2 in a horizontal section in the downstream portion of the head side passage 23. Note that a closing unit is formed of the first valve 7 and the third valve 9.

The pressure sensor 10 detects the pressure inside the ink passage 4. The pressure sensor 10 is disposed between the first valve 7 and the third valve 9.

The controller 11 controls operations of the entire inkjet printer 1. The controller 11 includes a CPU, a RAM, a ROM, a hard disk drive, and the like. The controller 11 executes the air bubble discharge processing to be described later, for example, after initial filling of the inkjet head 2 with the ink.

Next, the air bubble discharge processing in the inkjet printer 1 is described.

The air bubble discharge processing is processing of discharging air bubbles entrained in the ink in the ink passage 4. The air bubble discharge processing is performed, for example, subsequent to an operation of initial filling of the inkjet head 2 with the ink.

Here, the initial filling of the inkjet head 2 with the ink is performed as follows. First, the first valve 7 is closed in the state where the inkjet head 2, the ink passage 4, and the branching passage 5 are filled with no ink. Then, the controller 11 drives the liquid delivery pump 6 in the forward direction with the second valve 8 and the third valve 9 being open. This causes the ink to be supplied from the ink cartridge 3 to the ink passage 4 and flow toward the inkjet head 2 via the branching passage 5.

When the ink is filled to the middle of the head side passage 23, the controller 11 opens the first valve 7 and closes the second valve 8. In this case, air exists in the direct passage 22. Opening the first valve 7 and closing the second valve 8 causes the ink to flow into the direct passage 22 from the downstream side and the air moves from the upstream side of the direct passage 22 to the branching passage 5. Thereafter, the controller 11 closes the first valve 7 and opens the second valve 8. The air is thereby sent from the branching passage 5 to a portion downstream of the merging joint 27 in the ink passage 4. Repeating such opening and closing operations of the first valve 7 and the second valve 8 multiple times sends the air in the direct passage 22 to the portion downstream of the merging joint 27 in the ink passage 4.

Then, the controller 11 continues the forward direction drive of the liquid delivery pump 6 to fill the inkjet head 2 with the ink with the first valve 7 being set to the closed state and the second valve 8 set to the open state. In this case, the air originally existing in the direct passage 22 is sent to the inkjet head 2 together with the ink and is discharged from the nozzles. The inkjet head 2 and the ink passage 4 are thereby filled with the ink and the initial filling is completed.

When the air originally existing in the direct passage 22 is sent to the inkjet head 2 in the aforementioned initial filling operation, the air passes through the filter 29 and is thereby divided into fine air bubbles. The air bubbles tend to accumulate in the horizontal section in the downstream portion of the head side passage 23. Air bubble discharge processing is performed to discharge these accumulating air bubbles.

Figure 2:
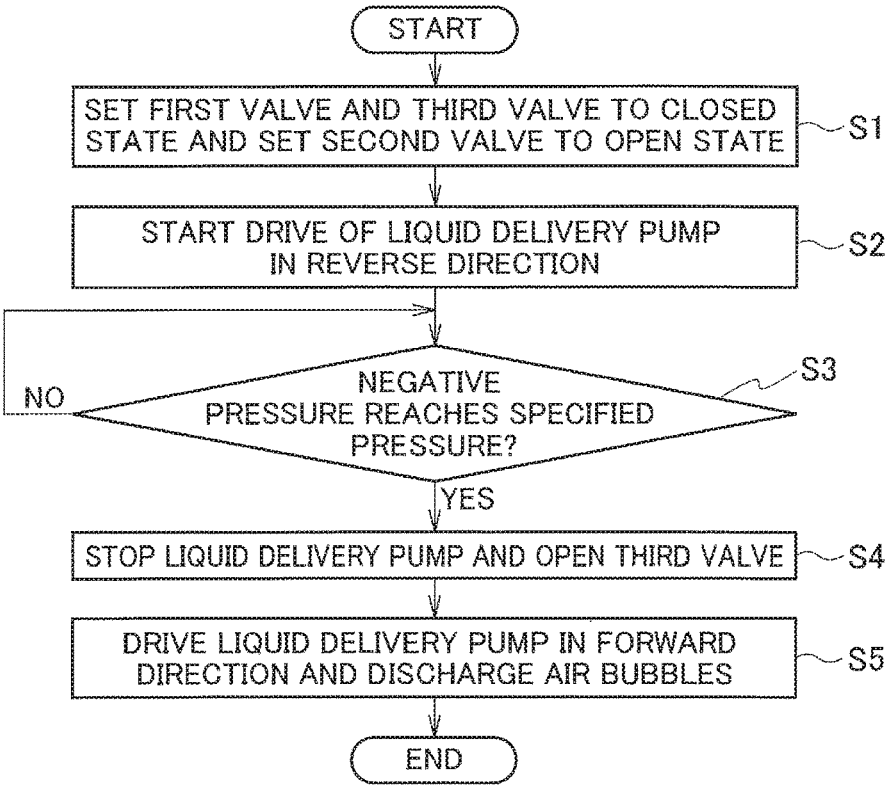
FIG. 2 is a flowchart of air bubble discharge processing according to the first embodiment.

FIG. 2 is a flowchart of the air bubble discharge processing in the first embodiment. First, in step S1 of FIG. 2, the controller 11 sets the first valve 7 and the third valve 9 to the closed state and sets the second valve 8 to the open state. A section between the first valve 7 and the third valve 9 thereby becomes a closed passage.

At the time of completion the filling of the inkjet head 2 with the ink in the aforementioned initial filling operation, the first valve 7 is set to the closed state and the second valve 8 and the third valve 9 are set to the open state. Accordingly, when the air bubble discharge processing is performed subsequent to the aforementioned initial filling, in step S1, the controller 11 maintains the closed state of the first valve 7 and the open state of the second valve 8 and closes the third valve 9.

Figure 3:
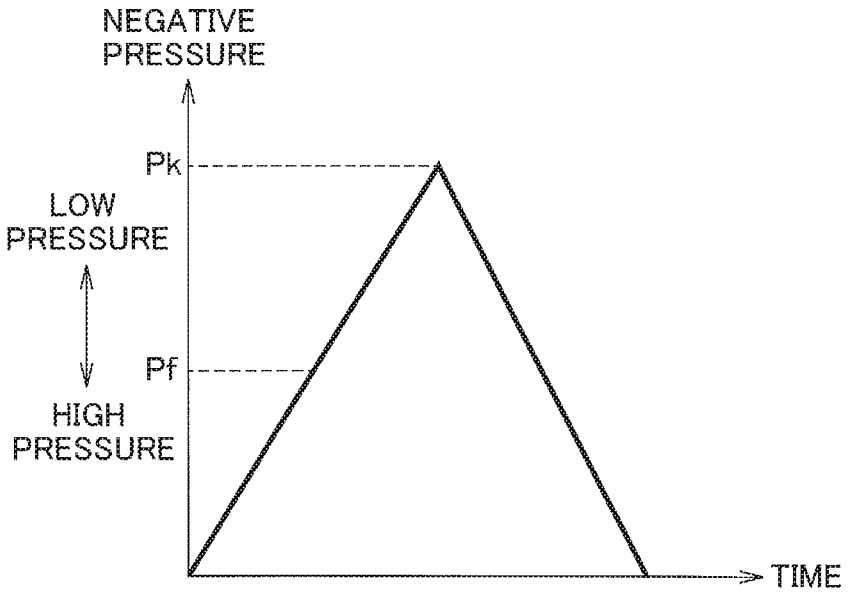
FIG. 3 is a graph illustrating a pressure change in a passage between a first valve and a third valve, from start of reverse direction drive of a liquid delivery pump in the air bubble discharge processing according to the first embodiment.

Next, in step S2, the controller 11 starts to drive the liquid delivery pump 6 in the reverse direction. As illustrated in FIG. 3, the negative pressure thereby starts to be generated in the closed passage between the first valve 7 and the third valve 9. FIG. 3 is a graph illustrating a pressure change in the passage between the first valve 7 and the third valve 9, from the start of the reverse direction drive of the liquid delivery pump 6 in the air bubble discharge processing according to the first embodiment.

Figure 4:
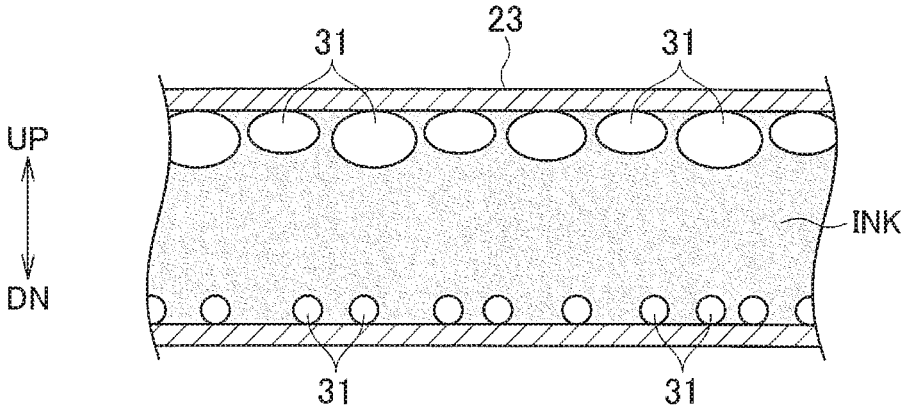
FIG. 4 is a view schematically illustrating a condition of air bubbles accumulating in an ink passage.

FIG. 4 schematically illustrates a condition of the air bubbles accumulating in the horizontal section in the downstream portion of the head side passage 23 at the start of the air bubble discharge processing. As illustrated in FIG. 4, air bubbles with relatively large volumes out of air bubbles 31 accumulating in the head side passage 23 float in the ink. Moreover, there are air bubbles with relatively small volumes. These air bubbles have small buoyancy and some of them thus adhere to an inner wall on a lower side of the head side passage 23.

When the reverse direction drive of the liquid delivery pump 6 starts in step S2 of FIG. 2, the negative pressure starts to be generated in the closed passage between the first valve 7 and the third valve 9, and the volumes of the air bubbles 31 start to increase. When the volumes of the air bubbles 31 increase, the buoyancy of the air bubbles 31 increases and the air bubbles 31 attaching to the inner wall of the head side passage 23 start to float up.

After the start of the reverse direction drive of the liquid delivery pump 6, in step S3, the controller 11 determines whether the negative pressure in the closed passage between the first valve 7 and the third valve 9 reaches a prescribed pressure Pk, based on a detection value of the pressure sensor 10.

The prescribed pressure Pk is set in advance as a pressure (negative pressure) for promoting joining of the adjacent air bubbles 31. The prescribed pressure Pk is set to be a negative pressure larger than a float pressure Pf (a pressure lower than the float pressure Pf).

The float pressure Pf is a pressure (negative pressure) assumed to be required to make the air bubbles 31 attaching to the inner wall of the head side passage 23 float up.

The smaller the air bubbles 31 are, the larger the negative pressure required to make the air bubbles 31 float up is. However, when the negative pressure is too large, the ink passage 4 may be damaged. Accordingly, the float pressure Pf is set to be a negative pressure required to make the air bubbles 31 with diameters equal to or greater than an assumed minimum diameter (for example, 0.1 mm) float up. The float pressure Pf and the prescribed pressure Pk are obtained based on experiments and the like.

Figure 5:
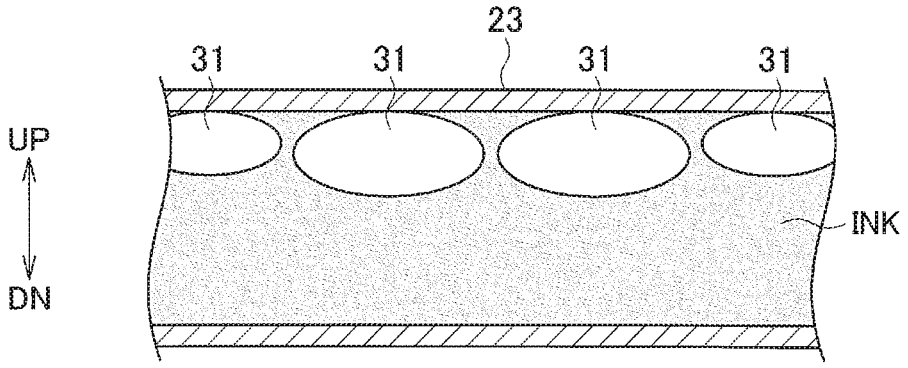
FIG. 5 is a view schematically illustrating a condition of air bubbles in a closed passage in which a prescribed negative pressure is generated in the air bubble discharge processing.

When the negative pressure in the closed passage reaches the float pressure Pf after the start of the reverse direction drive of the liquid delivery pump 6, the air bubbles 31 attaching to the inner wall of the head side passage 23 as described above start to float up. Thereafter, the negative pressure in the closed passage is increased to the prescribed pressure Pk and this causes the volumes of the floating-up air bubbles 31 to further increase. Moreover, the volumes of the originally-floating air bubbles 31 also increase by the time when the negative pressure in the closed passage reaches the prescribed pressure Pk. This promotes joining of adjacent ones of the originally-floating air bubbles 31 and the floating-up air bubbles 31. As illustrated in FIG. 5, the air bubbles 31 can be thus made larger than those in FIG. 4.

When the controller 11 determines that the negative pressure in the closed passage between the first valve 7 and the third valve 9 does not reach the prescribed pressure Pk in step S3 of FIG. 2 (step S3: NO), the controller 11 repeats step S3.

When the controller 11 determines that the negative pressure in the closed passage between the first valve 7 and the third valve 9 reaches the prescribed pressure Pk (step S3: YES), in step S4, the controller 11 stops the liquid delivery pump 6. Moreover, the controller 11 opens the third valve 9.

The closure of the passage between the first valve 7 and the third valve 9 is thereby released and, as illustrated in FIG. 3, the negative pressure in the passage between the first valve 7 and the third valve 9 is released.

When the negative pressure in the passage between the first valve 7 and the third valve 9 is released, the volumes of the air bubbles 31 decrease. However, since the joined air bubbles 31 continues to be joined together, the state where the air bubbles 31 are larger than those in the state before the air bubble discharge processing as illustrated in FIG. 4 is maintained.

Then, in step S5, the controller 11 drives the liquid delivery pump 6 in the forward direction to send the air bubbles 31 to the inkjet head 2 together with the ink and discharge them from the nozzles. In the air bubble discharge processing, the air bubbles 31 join together to form the larger air bubbles 31. Since the large air bubbles 31 tend to be carried away by the flowing ink, the air bubbles 31 are less likely to remain in the ink passage 4. When the forward direction drive of the liquid delivery pump 6 for the air bubble discharge is completed, the air bubble discharge processing is terminated.

As described above, in the inkjet printer 1, in the air bubble discharge processing, the controller 11 closes the first valve 7 and the third valve 9 to form the closed passage and drives the liquid delivery pump 6 in the reverse direction. When the negative pressure in the closed passage reaches the prescribed pressure Pk, the controller 11 stops the reverse direction drive of the liquid delivery pump 6 and opens the third valve 9, and then drives the liquid delivery pump 6 in the forward direction to discharge the air bubbles from the inkjet head 2 together with the ink. The air bubbles 31 attaching to the inner wall of the head side passage 23 can be thereby discharged by being made to float up and joined together to form the larger air bubbles 31. As a result, it is possible to facilitate the discharge of the air bubbles 31 and reduce the air bubbles 31 in the ink passage 4.

Moreover, since the negative pressure can be generated in a short time by the reverse direction drive of the liquid delivery pump 6, the air bubbles can be discharged in a short time in the aforementioned air bubble discharge processing.

Note that, in the inkjet printer 1, the air bubbles are sometimes entrapped in the ink passage 4 due to replacement of the ink cartridge 3. To counter this, after the replacement of the ink cartridge 3, the liquid delivery pump 6 is driven in the forward direction to discharge the air bubbles from the nozzles of the inkjet head 2. In this case, the air bubbles divided by the filter 29 sometimes accumulate in the horizontal section in the downstream portion of the head side passage 23. Accordingly, the aforementioned air bubble discharge processing may be performed after the ink cartridge 3 is replaced and the liquid delivery pump 6 is driven in the forward direction to discharge the air bubbles.

Second Embodiment

Next, description is given of a second embodiment in which the air bubble discharge processing of the first embodiment is changed.

In the second embodiment, in the air bubble discharge processing, when the negative pressure in the closed passage reaches the float pressure Pf, the controller 11 controls the liquid delivery pump 6 such that the negative pressure is maintained at the float pressure Pf for a prescribed time T and then increased to the prescribed pressure Pk.

Figure 6:
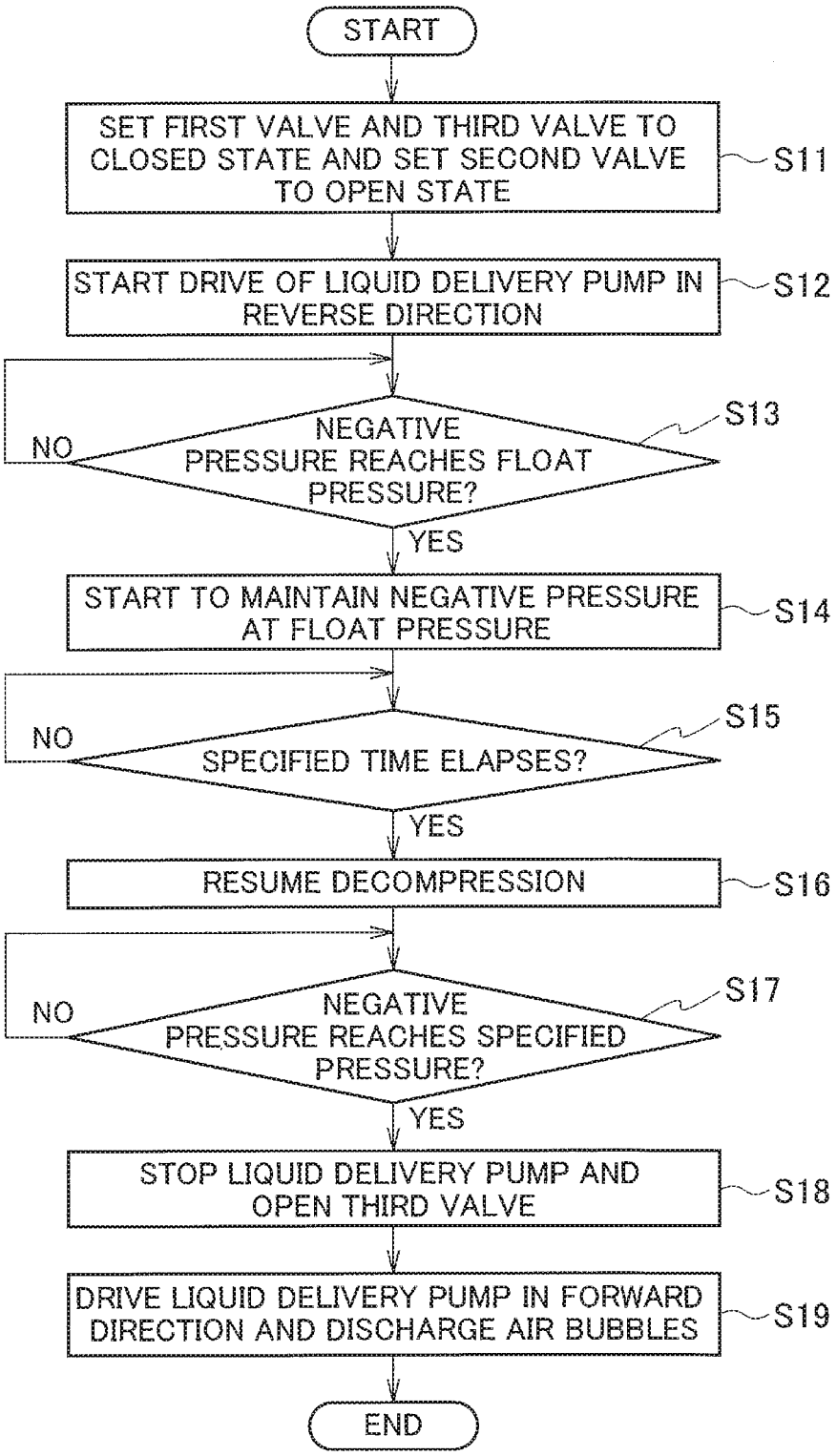
FIG. 6 is a flowchart of air bubble discharge processing according to a second embodiment.
Figure 7:
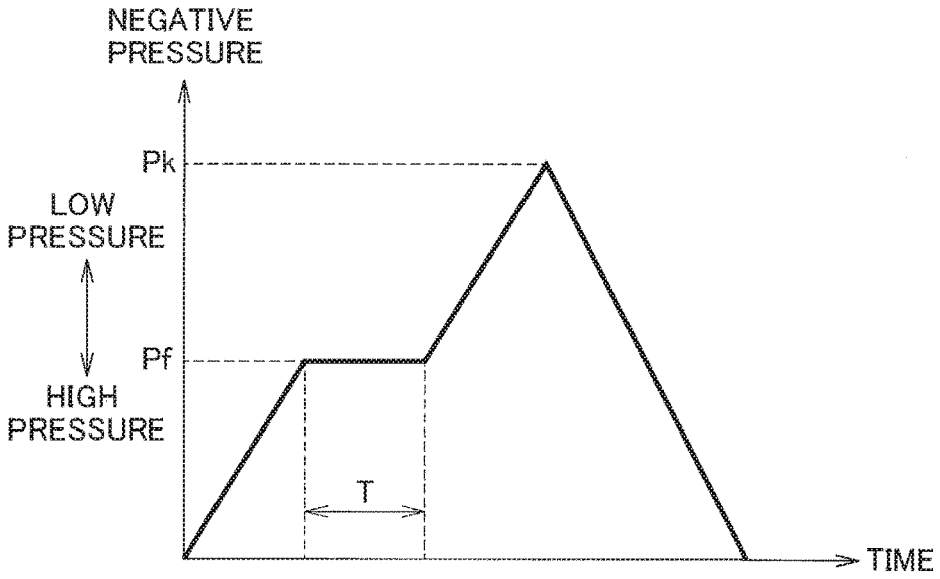
FIG. 7 is a graph illustrating a pressure change in the passage between the first valve and the third valve, from start of reverse direction drive of the liquid delivery pump in air bubble discharge processing according to a third embodiment.

FIG. 6 is a flowchart of the air bubble discharge processing in the second embodiment. FIG. 7 is a graph illustrating a pressure change in the passage between the first valve 7 and the third valve 9 from the start of the reverse direction drive of the liquid delivery pump 6 in the air bubble discharge processing according to the second embodiment.

Processes of steps S11, S12 of FIG. 6 are the same as the aforementioned processes of steps S1, S2 in FIG. 2.

In step S13, the controller 11 determines whether the negative pressure in the closed passage between the first valve 7 and the third valve 9 reaches the float pressure (waiting pressure) Pf, based on the detection value of the pressure sensor 10. When the controller 11 determines that the negative pressure in the closed passage between the first valve 7 and the third valve 9 does not reach the float pressure Pf (step S13: NO), the controller 11 repeats step S13.

When the controller 11 determines that the negative pressure in the closed passage between the first valve 7 and the third valve 9 reaches the float pressure Pf (step S13: YES), in step S14, the controller 11 controls the liquid delivery pump 6 to start maintaining the negative pressure in the closed passage at the float pressure Pf.

Next, in step S15, the controller 11 determines whether the prescribed time T elapses from the start of maintaining the negative pressure in the closed passage at the float pressure Pf. The prescribed time T is set as a time waiting for the air bubbles 31 attaching to the inner wall on the lower side of the horizontal section in the head side passage 23 to float up and reach the inner wall on the upper side, from the time point at which the negative pressure in the closed passage between the first valve 7 and the third valve 9 reaches the float pressure Pf. The prescribed time T is set in advance based on experiments and the like.

When the controller 11 determines that the prescribed time T does not elapse from the start of maintaining the negative pressure in the closed passage at the float pressure Pf (step S15: NO), the controller 11 repeats step S11.

When the controller 11 determines that the prescribed time T elapses from the start of maintaining the negative pressure in the closed passage at the float pressure Pf (step S15: YES), in step S16, the controller 11 controls the liquid delivery pump 6 to resume decompression. As illustrated in FIG. 7, the negative pressure in the closed passage is thus maintained at the float pressure Pf for the prescribed time T and then starts to be increased again.

Processes of steps S17 to S19 after step S16 are the same as the aforementioned processes of steps S3 to S5 in FIG. 2.

As described above, in the second embodiment, when the negative pressure in the closed passage reaches the float pressure Pf, the controller 11 controls the liquid delivery pump 6 such that the negative pressure is maintained at the float pressure Pf for the prescribed time T and then increased to the prescribed pressure Pk. Providing the time waiting for the air bubbles 31 attaching to the inner wall of the head side passage 23 to float up can cause more air bubbles 31 to be joined. As a result, it is possible to facilitate the discharge of the air bubbles 31 and reduce the air bubbles 31 in the ink passage 4.

Third Embodiment

Figure 8:
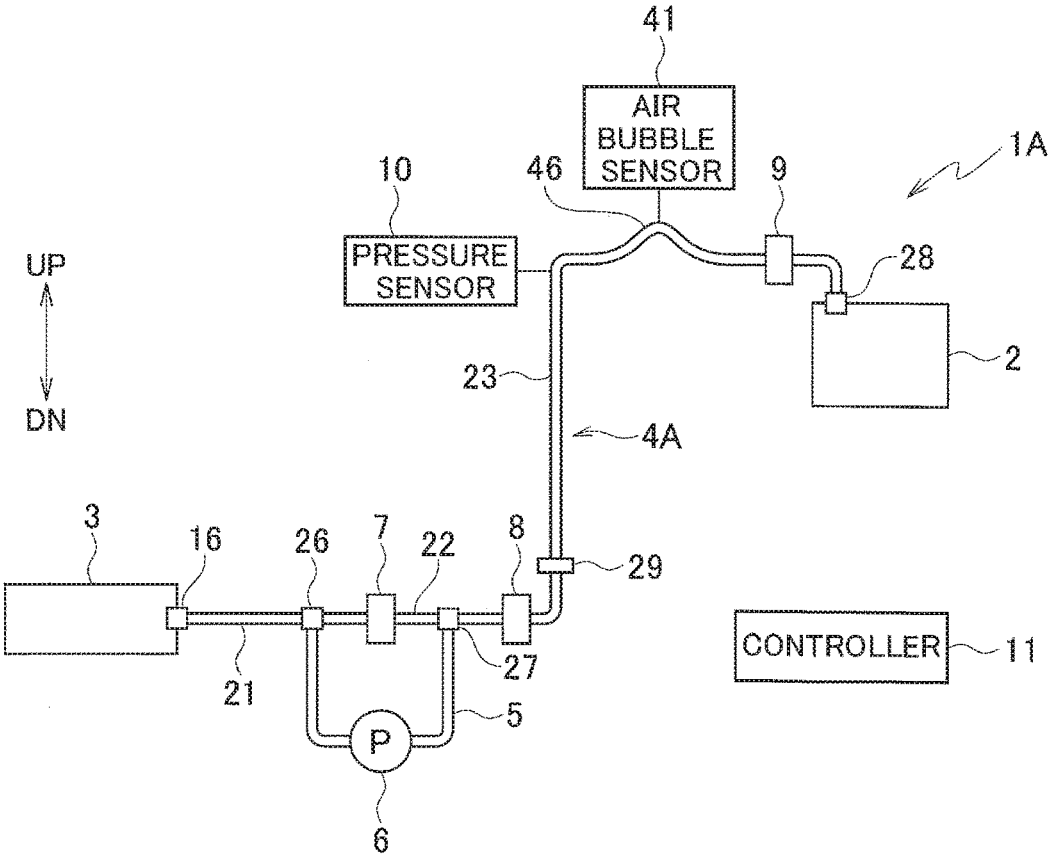
FIG. 8 is a schematic configuration diagram of an inkjet printer according to the third embodiment.

Next, description is given of a third embodiment in which part of the first embodiment is changed. FIG. 8 is a schematic configuration diagram of an inkjet printer 1A according to the third embodiment.

As illustrated in FIG. 8, the inkjet printer 1A is different from the inkjet printer 1 of the first embodiment in that the ink passage 4 is replaced by an ink passage 4A and an air bubble sensor (air bubble detector) 41 is added.

The ink passage 4A is different from the ink passage 4 of the first embodiment in that a protruding portion 46 is provided. The protruding portion 46 is a portion in which part of the head side passage 23 is formed in an arch shape protruding upward in the vertical direction. The protruding portion 46 is formed upstream of the third valve 9, in the horizontal section in the downstream portion of the head side passage 23. In other words, the protruding portion 46 is in a section of the ink passage 4A which is closed by the first valve 7 and the third valve 9.

The air bubble sensor 41 detects the air bubbles in the protruding portion 46 in the ink passage 4A. The air bubble sensor 41 is, for example, an ultrasonic sensor.

When the air bubble sensor 41 detects the air bubbles accumulating in the protruding portion 46, the controller 11 executes the air bubble discharge processing in the aforementioned first embodiment or second embodiment.

In the inkjet printer 1A, since the air bubbles tend to accumulate in the protruding portion 46, presence or absence of the air bubbles accumulating in the ink passage 4A can be determined from the detection result of the air bubbles accumulating in the protruding portion 46 provided by the air bubble sensor 41. Executing the air bubble discharge processing when the air bubble sensor 41 detects the air bubbles accumulating in the protruding portion 46 allows the air bubble discharge processing to be efficiently performed depending on presence or absence of the air bubbles accumulating in the ink passage 4A.

Moreover, since the air bubbles tend to gather in the protruding portion 46, the joining of the air bubbles can be promoted in the air bubble discharge processing. This can facilitate discharging of the air bubbles and further reduce the air bubbles in the ink passage 4.

Other Embodiments

Although the liquid delivery pump 6 is used as a negative pressure generator in the first to third embodiments, the negative pressure generator is not limited to this. For example, it is possible to employ a configuration in which a syringe is connected to the section between the first valve 7 and the third valve 9 in the ink passage 4, 4A and the negative pressure is generated in the closed passage by this syringe. An air pump may be used instead of the syringe.

Although the configuration in which part of the ink passage 4, 4A is set as a closed passage by the first valve 7 and the third valve 9 in the air bubble discharge processing is described in the first to third embodiments, the entire ink passage may be closed.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

an inkjet head;

an ink passage connected to the inkjet head for supplying ink from an ink tank to the inkjet head;

a closing unit configured to close at least part of the ink passage to form a closed passage;

a negative pressure generator configured to generate a negative pressure in the closed passage formed by the closing unit;

an ink deliverer configured to deliver ink to the inkjet head via the ink passage; and a controller configured to control the closing unit, the negative pressure generator, and the ink deliverer, wherein the controller is configured to execute an air bubble discharge processing including:

driving the closing unit to form the closed passage;

driving the negative pressure generator to generate the negative pressure in the closed passage; and upon the negative pressure in the closed passage reaching a prescribed pressure, stopping the negative pressure generator while driving the closing unit to release closure of the at least part of the ink passage, and driving the ink deliverer to discharge an air bubble together with the ink in the at least part of ink passage from the inkjet head.

2. The inkjet printer according to claim 1, wherein in the air bubble discharge processing, upon the negative pressure in the closed passage reaching a waiting pressure smaller than the prescribed pressure, the controller controls the negative pressure generator to maintain the negative pressure in the closed passage at the waiting pressure for a prescribed time and then increase the negative pressure in the closed passage to the prescribed pressure.

3. The inkjet printer according to claim 1, wherein the at least part of the ink passage has a protruding portion protruding upward in a vertical direction.

4. The inkjet printer according to claim 1, wherein the closing unit comprises valves, and a single pump functions as both the negative pressure generator and the ink deliverer, and the single pump is configured to be driven selectively in forward and reverse directions.

5. The inkjet printer according to claim 1, wherein the closing unit includes valves.

6. The inkjet printer according to claim 1, wherein driving the negative pressure generator to generate the negative pressure in the closed passage allows air bubbles attaching to an inner wall of the closed passage to float up and join together.

7. An inkjet printer comprising:

an inkjet head;

an ink passage connected to the inkjet head;

a closing unit configured to close at least part of the ink passage to form a closed passage;

a negative pressure generator configured to generate a negative pressure in the closed passage formed by the closing unit;

an ink deliverer configured to deliver ink to the inkjet head via the ink passage; and a controller configured to control the closing unit, the negative pressure generator, and the ink deliverer;

the controller being configured to execute an air bubble discharge processing including:

driving the closing unit to form the closed passage;

driving the negative pressure generator to generate the negative pressure in the closed passage; and upon the negative pressure in the closed passage reaching a prescribed pressure, stopping the negative pressure generator while driving the closing unit to release closure of the at least part of the ink passage, and driving the ink deliverer to discharge an air bubble together with the ink in the at least part of ink passage from the inkjet head;

the at least part of the ink passage having a protruding portion protruding upward in a vertical direction;

the inkjet printer further comprising an air bubble detector configured to detect an air bubble at the protruding portion in the ink passage; and wherein the controller executes the air bubble discharge processing upon detection of the air bubble accumulated at the protruding portion by the air bubble detector.

8. The inkjet printer according to claim 7, wherein the closing unit comprises valves, and the negative pressure generator and the ink deliverer comprise a pump.

* * * * *